US009862541B2

(12) United States Patent
Fritch

(10) Patent No.: US 9,862,541 B2
(45) Date of Patent: Jan. 9, 2018

(54) TRASH RECEPTACLE ATTACHMENT

(71) Applicant: Joseph Fritch, Nutley, NJ (US)

(72) Inventor: Joseph Fritch, Nutley, NJ (US)

( * ) Notice: Subject to any disclaimer, the term of this patent is extended or adjusted under 35 U.S.C. 154(b) by 0 days.

(21) Appl. No.: 14/943,742

(22) Filed: Nov. 17, 2015

(65) Prior Publication Data

US 2016/0145041 A1 May 26, 2016

Related U.S. Application Data

(60) Provisional application No. 62/084,993, filed on Nov. 26, 2014.

(51) Int. Cl.
*B65D 6/28* (2006.01)
*B65F 1/10* (2006.01)

(52) U.S. Cl.
CPC ..... *B65F 1/10* (2013.01); *B65F 2240/138* (2013.01)

(58) Field of Classification Search
CPC ..... B65F 1/10; B65B 67/04
See application file for complete search history.

(56) References Cited

U.S. PATENT DOCUMENTS 2,552,318 A * 5/1951 Hartmann ..... B65D 25/48 215/387
3,771,752 A 11/1973 Meeh
D308,270 S 5/1990 Sarabia
5,765,614 A 6/1998 Kardosh
7,302,978 B1 12/2007 Kolarik
8,757,563 B2 6/2014 Muse
2003/0173471 A1* 9/2003 Weathers ..... B65B 67/04 248/99
2008/0185391 A1* 8/2008 Monmany ..... B44D 3/127 220/694
2012/0012228 A1 1/2012 Karabas et al.

* cited by examiner

*Primary Examiner* — Jeffrey Allen

(74) *Attorney, Agent, or Firm* — Global Intellectual Property Agency, LLC; Jordan Sworen

(57) ABSTRACT

A trash receptacle attachment for helping to collect debris. The trash receptacle attachment includes a housing having an inlet portion, an outlet portion, and a hollow interior volume. The outlet portion is configured to be received within a trash receptacle, wherein mounting brackets attached to the exterior of the housing and are configured to removably mount to an opening of the trash receptacle to support the outlet portion within the trash receptacle. The inlet portion extends above the opening of the trash receptacle when the outlet portion is supported within the trash receptacle, wherein the inlet portion includes a funnel-like shape and is widened relative to the outlet portion. Debris is inserted into the inlet portion and the debris passes through the housing and the outlet portion thereof, into the interior of the trash receptacle.

5 Claims, 3 Drawing Sheets

TRASH RECEPTACLE ATTACHMENT

CROSS REFERENCE TO RELATED APPLICATION

This application claims the benefit of U.S. Provisional Application No. 62/084,993 filed on Nov. 26, 2014. The above identified patent application is herein incorporated by reference in its entirety to provide continuity of disclosure.

FIELD OF THE INVENTION

The present invention relates to trash collection devices. Specifically, the present invention relates to a trash receptacle attachment that allows a user to more easily deposit debris into a trash receptacle.

BACKGROUND OF THE INVENTION

Raking and disposing of leaves can be a time consuming and burdensome task. Raking leaves requires a considerable amount of manual labor and once the leaves are raked, they must then be deposited into a trash receptacle. Other debris on a lawn must also be collected such as cut grass, sticks, twigs, and litter. Thus, a person may be required to periodically rake their lawn or backyard throughout the year, particularly during fall.

Many people rake leaves and debris into a pile and then insert the debris into a garbage bag for disposal. However, this requires the user to pick up the leaves and debris by hand which can be inefficient and undesirable. Alternatively, the user may try to rake leaves directly into a garbage bag, however, it can be difficult to hold the garbage bag in an open position while simultaneously raking leaves into the bag. Thus, an improved means for disposing of debris is desired.

Devices have been disclosed in the prior art that relate to funnels for filling containers with debris. These devices include rectangularly shaped hoppers for insertion within a refuse bag, whereby the hoppers include tapered upper portions and elongated distal ends. Other devices include refuse bag holders having clamps for attachment onto a refuse bag. These devices, however, fail to provide an inlet portion having a rectangular funnel shape and an outlet portion having a pair of mounting brackets configured to removably mount to a trash receptacle.

It is therefore submitted that the present invention is substantially divergent in design elements from the prior art, and consequently it is clear that there is a need in the art for an improvement to trash collecting devices. In this regard, the instant invention substantially fulfills these needs.

SUMMARY OF THE INVENTION

In view of the foregoing disadvantages inherent in the known types of trash receptacle attachments now present in the prior art, the present invention provides a trash receptacle attachment, wherein the same can be utilized for removably mounting to a trash receptacle to assist in the collection of lawn debris.

It is therefore an object of the invention to provide a new and improved trash receptacle attachment that has all of the advantages of the prior art and none of the disadvantages.

Another object of the present invention is to provide a new and improved trash receptacle attachment having an inlet portion and an outlet portion, wherein the outlet portion is configured to be received and supported within a trash receptacle.

Yet another object of the present invention is to provide a new and improved trash receptacle attachment, wherein the outlet portion includes mounting brackets configured to removably fasten around the opening of the trash receptacle.

Still yet another object of the present invention is to provide a new and improved trash receptacle attachment, wherein the inlet portion is configured to be situated above the trash receptacle.

A further object of the present invention is to provide a new and improved trash receptacle attachment, wherein the inlet portion is rectangular funnel shaped, which allows for lawn debris to be pushed through towards the outlet portion and into the trash receptacle.

Still yet another object of the present invention is to provide a new and improved trash receptacle attachment wherein the device may be readily fabricated from materials that permit relative economy and are commensurate with durability.

Other objects, features, and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
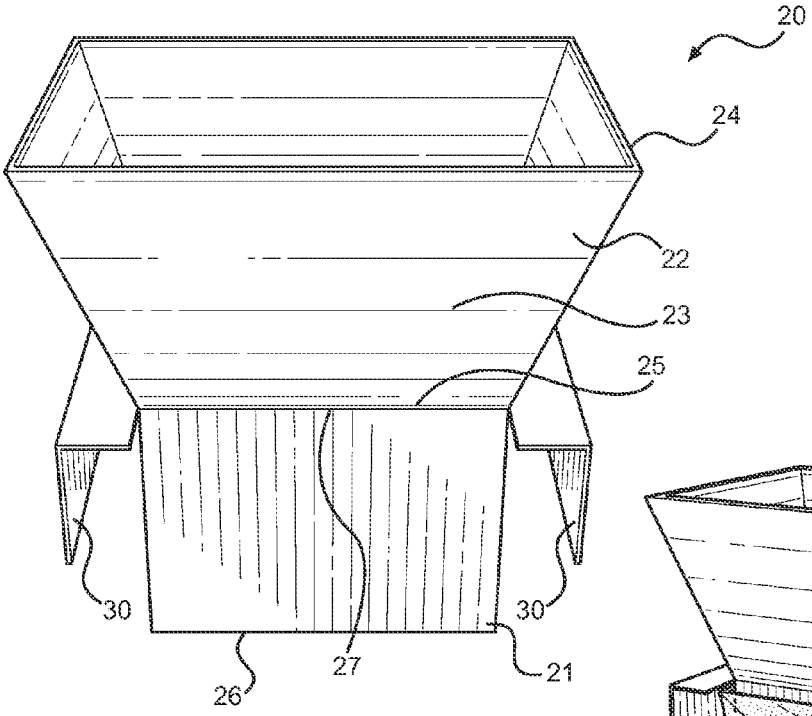
FIG. 1 shows a front perspective view of the trash receptacle attachment.

Reference is made herein to the attached drawings. Like reference numerals are used throughout the drawings to depict like or similar elements of the trash receptacle attachment. For the purposes of presenting a brief and clear description of the present invention, the preferred embodiment will be discussed as used for facilitating the collection of leaves and other yard debris in a trash receptacle. The figures are intended for representative purposes only and should not be considered to be limiting in any respect.

Figure 2:
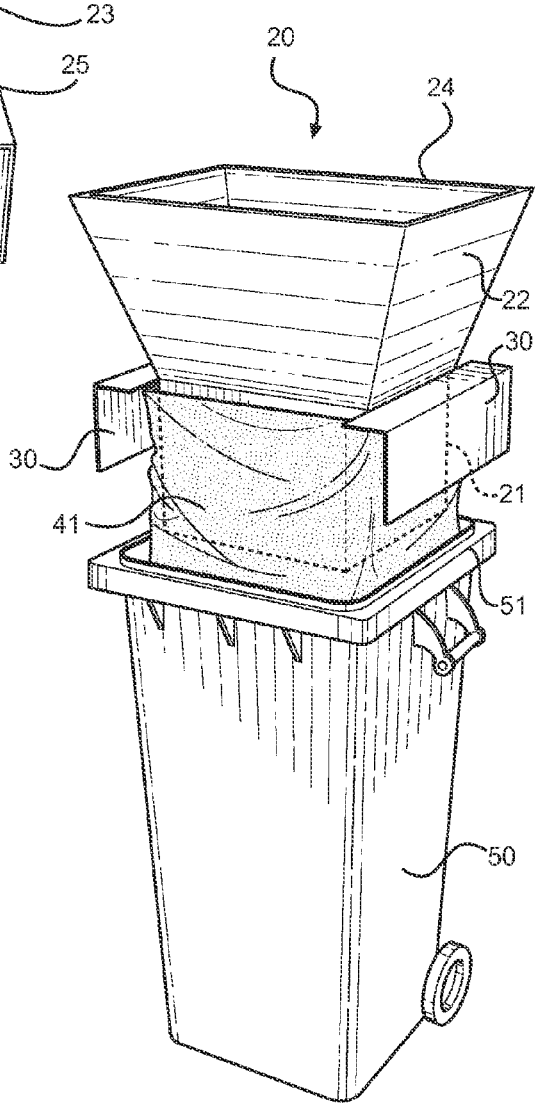
FIG. 2 shows a perspective view of the trash receptacle attachment as positioned for securement to a trash receptacle.

Referring now to FIGS. 1 and 2, there is shown a front perspective view of the trash receptacle attachment and a perspective view of the trash receptacle attachment as positioned for securement to a trash receptacle, respectively. The trash receptacle attachment 20 is configured to be removably fastened to a trash receptacle, such as a trash can, to facilitate the collection of leaves and debris within the trash receptacle. The trash receptacle attachment 20 comprises a housing 23 having an inlet portion 22, an outlet portion 21, and a hollow interior volume. The housing 23 comprises a unitary body and can be composed of any of various durable materials, such as a metal or thermoset material, among others.

The inlet portion 22 comprises an upper end 24 and a lower end 25. The upper end 24 is open so as to allow debris to be inserted into the inlet portion 22. The inlet portion 22 further comprises a tapered configuration, wherein the inlet portion 22 tapers from the upper end 24 thereof towards the lower end 25. In this way, the upper end 24 of the inlet portion 22 is widened relative to the outlet portion 21. Preferably, the inlet portion 22 is in the shape of a rectangular funnel.

The inlet portion 22 is connected to the outlet portion 21 such that debris inserted into the inlet portion 22 passes through the outlet portion 21. The outlet portion 21 comprises an upper end 27 and a lower end 26. The upper end 27 is connected to the lower end 25 of the inlet portion 22 so as to form a continuous surface. The lower end 26 is open so that debris can flow therethrough and into a trash receptacle. Preferably, the outlet portion 21 is rectangular prism in shape, wherein the interior volume is uniform in shape. In this way, the interior volume of the inlet portion 22 is in communication with the interior volume of the outlet portion 21, whereby debris entering through the interior volume of the inlet portion 22 can pass through the outlet portion 21 and into the trash receptacle 50.

The upper end 25 of the lower portion further includes one or more brackets 30 configured to removably attach the attachment 20 to the upper end 51 of the trash receptacle 50. Preferably, each bracket 30 is L-shaped and configured to removably fasten around the opening of the trash receptacle 50, which allows the inlet portion 22 to be situated above the opening of the trash receptacle 50. Furthermore, the outlet portion 21 is configured to be received by a lawn debris bag or plastic bag, which can also be received and supported by the trash receptacle 50, thereby facilitating the collection of lawn debris within the lawn debris bag or plastic bag.

Figure 3:
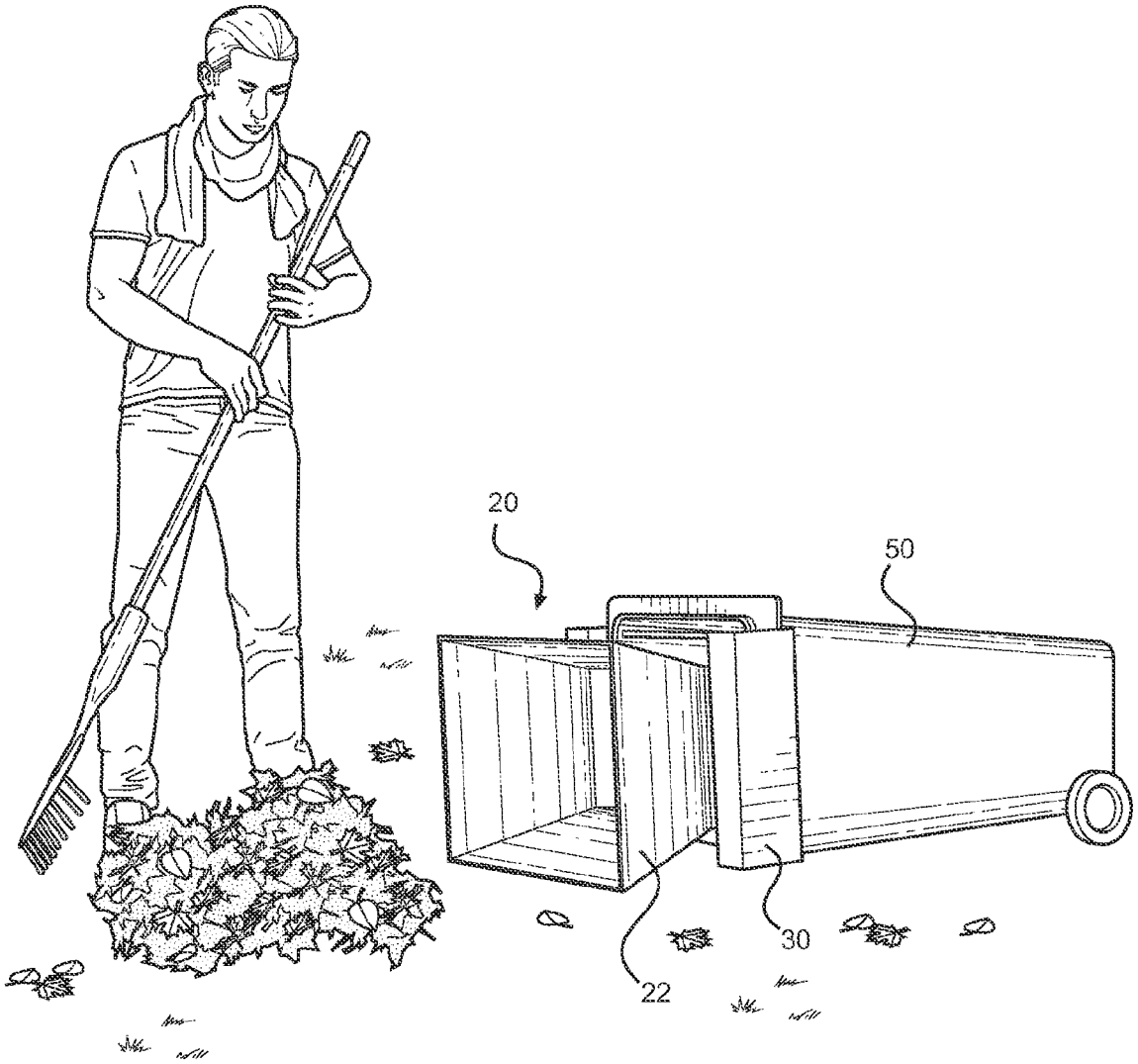
FIG. 3 shows a perspective view of the trash receptacle attachment in use.

Referring now to FIG. 3, there is shown a perspective view of the trash receptacle attachment in use. In operation, the outlet portion is inserted into a trash bag or a trash receptacle 50. The housing of the trash receptacle attachment 20 is affixed to the open upper end of the trash receptacle 50 via the brackets 30 thereon. The brackets 30 are removably secured to the trash receptacle 50 and do not require additional fasteners. Once the brackets 30 are secured to the trash receptacle 50, the inlet portion 22 extends outward from the trash receptacle 50. The trash receptacle 50 is placed on its side so that the inlet portion 20 rests on the ground. The inlet portion 20 is preferably a rectangular funnel so that an edge of the rectangular funnel can rest substantially flush against the ground. In this way, the user can simply rake leaves into the inlet portion, wherein the debris will then pass through the housing and outlet portion thereof, into the trash receptacle. This eliminates the need for the user to hold open a garbage bag or pick up the leaves and debris by hand.

Figure 4:
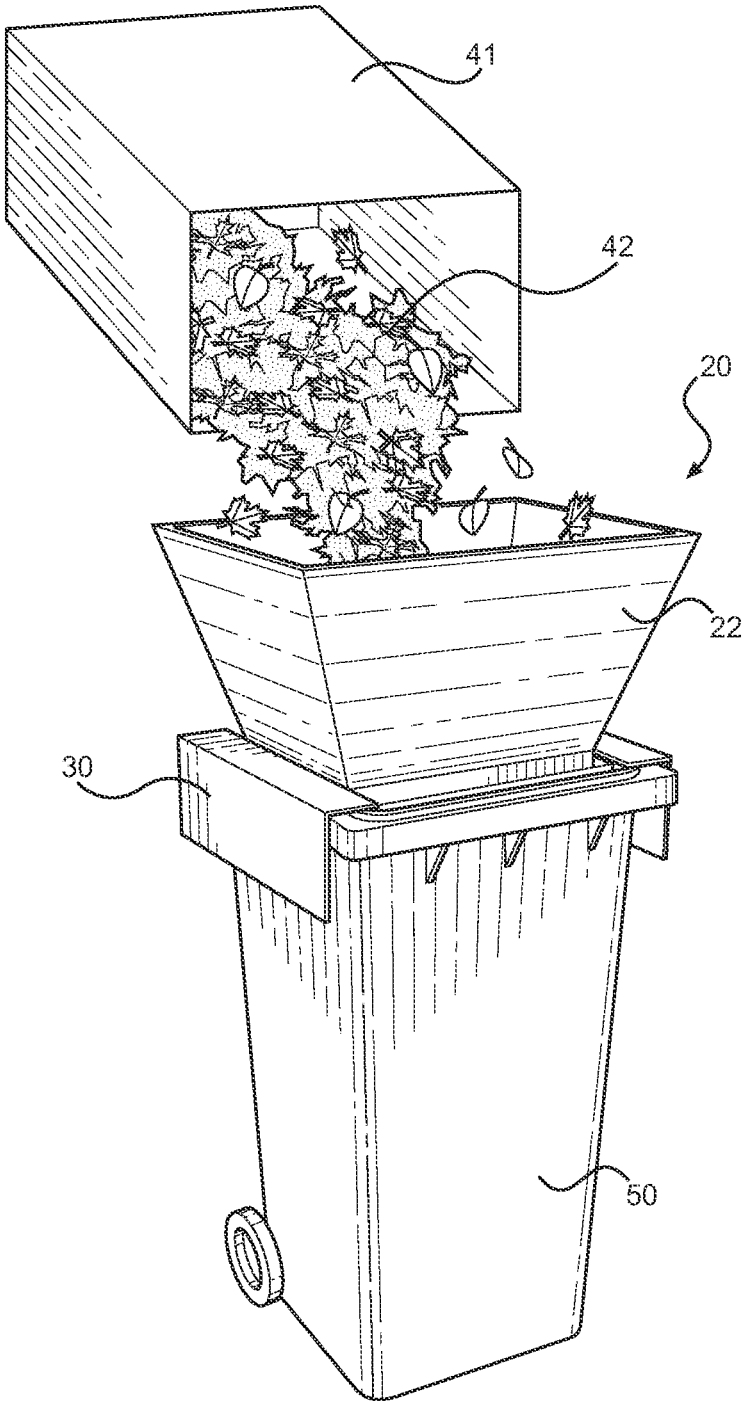
FIG. 4 shows a perspective view of the trash receptacle attachment in use.

Referring now to FIG. 4, there is shown a perspective view of the trash receptacle attachment in use. Alternatively, the user can utilize the trash receptacle attachment 20 in an upright position on a trash receptacle 50. The user can secure the trash receptacle attachment 20 to the trash receptacle 50 using the brackets 30 thereon. The user can then deposit leaves and debris 42 into the inlet portion 22 of the trash receptacle attachment 20, wherein the trash receptacle attachment 20 funnels the debris into the trash receptacle 50. This allows the user to dump bags 41 of leaves and debris into the trash receptacle 50 without spilling the leaves and debris.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A trash receptacle attachment, comprising:

a housing comprising an inlet portion, an outlet portion, and a hollow interior volume, wherein the inlet portion comprises an open upper end and wherein the outlet portion comprises an open lower end;

a first bracket extending along a first side of the housing and a second bracket extending along an opposing second side of the housing, the first bracket and the second bracket each comprising a horizontal member and a vertical member, the horizontal member affixed to a central edge defined by the intersection of a lower end of the inlet portion and an upper end of the outlet portion, the vertical member extending downwardly from and edge of the horizontal member;

a first gap disposed on a third side of the housing, the first gap spanning a distance between the first bracket and the second bracket, wherein the distance is equal to a width of the outlet portion;

the inlet portion comprising a funnel-shape;

wherein a length of the horizontal member of the first bracket is greater than a length of the first side, and a length of the horizontal member of the second bracket is greater than a length of the second side;

wherein the outlet portion is adapted to be inserted into the trash receptacle such that the inlet portion extends outward from the trash receptacle.

2. The trash receptacle attachment of claim 1, wherein the inlet portion comprises a rectangular funnel-shape.

3. The trash receptacle attachment of claim 1, wherein the one or more brackets comprise a pair of brackets affixed to opposing sides of the housing.

4. The trash receptacle attachment of claim 1, wherein the inlet portion is widened relative to the outlet portion.

5. The trash receptacle attachment of claim 1, wherein the outlet portion is substantially rectangular in configuration.

* * * * *